US007325506B2

(12) United States Patent
Yamashita et al.

(10) Patent No.: US 7,325,506 B2
(45) Date of Patent: Feb. 5, 2008

(54) OUTBOARD MOTOR CONTROL SYSTEM

(75) Inventors: Kosei Yamashita, Wako (JP); Kazuhiro Sato, Wako (JP); Kei Inoue, Wako (JP); Shinsaku Nakayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/411,418

(22) Filed: Apr. 20, 2006

(65) Prior Publication Data

US 2006/0240720 A1 Oct. 26, 2006

(30) Foreign Application Priority Data

Apr. 22, 2005 (JP) ..... 2005-124862

(51) Int. Cl.
*B63H 25/00* (2006.01)

(52) U.S. Cl. ..... 114/144 RE; 114/146; 701/21; 440/86; 440/87

(58) Field of Classification Search ..... 701/21; 114/144 R, 144 RE, 144 E, 146; 440/1, 440/84, 86, 87
See application file for complete search history.

(56) References Cited

U.S. PATENT DOCUMENTS 4,836,809 A * 6/1989 Pelligrino ..... 440/2
6,587,765 B1 * 7/2003 Graham et al. ..... 701/21
2005/0092225 A1 * 5/2005 Kaji et al. ..... 114/144 R
2005/0286539 A1 * 12/2005 Okuyama ..... 370/400

FOREIGN PATENT DOCUMENTS

JP 2004-052697 2/2004

* cited by examiner

*Primary Examiner*—Sherman Basinger
(74) *Attorney, Agent, or Firm*—Carrier, Blackman + Associates, P.C.; Joseph P. Carrier; William D. Blackman

(57) ABSTRACT

In an outboard motor control system, equipped with two outboard motors and actuators for steering, changing shift position and regulating engine speed, two navigation units responsive to operations of the operator for producing outputs indicative of actuator operation commands, two ECUs that control the operation of the actuators based on the outputs from the navigation units, an output forwarding ECU which forwards the outputs of one of the navigation units to the ECUs, and two switchover buttons for changing the outputs to be forwarded. Therefore, only the set of outputs for the one navigation unit selected by the operator is sent to the ECUs. In other words, in the case where multiple navigation units are provided, use of the navigation units is limited to a desired one thereof, so that the outboard motors can be stably controlled even when the control inputs to the individual navigation units are different.

9 Claims, 12 Drawing Sheets

FIG. 6

[LOW BOAT SPEED]

| θ sw | −540 | −360 | −180 | −5 | 0 | 5 | 180 | 360 | 540 |
|---|---|---|---|---|---|---|---|---|---|
| θ dr | −30.0 | −20.0 | −10.0 | −0.3 | 0 | 0.3 | 10.0 | 20.0 | 30.0 |
| θ dl | −30.0 | −20.0 | −10.0 | −0.3 | 0 | 0.3 | 10.0 | 20.0 | 30.0 |
| θ dl− θ dr | 0 | 0 | 0 | 0 | 0 | 0 | 0 | 0 | 0 |

UNIT [° ]

FIG. 7

[MEDIUM BOAT SPEED]

| θ sw | -540 | -360 | -180 | -5 | 0 | 5 | 180 | 360 | 540 |
|---|---|---|---|---|---|---|---|---|---|
| θ dr | -29.2 | -19.1 | -8.9 | -0.5 | -0.4 | 0.5 | 9.7 | 19.9 | 30.0 |
| θ dl | -30.0 | -19.9 | -9.7 | -0.5 | 0.4 | 0.5 | 8.9 | 19.1 | 29.2 |
| θ dl- θ dr | -0.8 | -0.8 | -0.8 | 0 | 0.8 | 0 | -0.8 | -0.8 | -0.8 |

UNIT [° ]

FIG. 10

[HIGH BOAT SPEED]

| θ sw | -540 | -360 | -180 | -5 | 0 | 5 | 180 | 360 | 540 |
|---|---|---|---|---|---|---|---|---|---|
| θ dr | -29.0 | -18.9 | -8.7 | -0.6 | -0.5 | 0.6 | 9.7 | 19.9 | 30.0 |
| θ dl | -30.0 | -19.9 | -9.7 | -0.6 | 0.5 | 0.6 | 8.7 | 18.9 | 29.0 |
| θ dl- θ dr | -1.0 | -1.0 | -1.0 | 0 | 1.0 | 0 | -1.0 | -1.0 | -1.0 |

UNIT [° ]

FIG. 11

[RAPID DECELERATION]

| θ sw | −540 | −360 | −180 | −5 | 0 | 5 | 180 | 360 | 540 |
|---|---|---|---|---|---|---|---|---|---|
| θ dr | −28.0 | −17.9 | −7.7 | 0.2 | 0.5 | 1.3 | 9.7 | 19.9 | 30.0 |
| θ dl | −30.0 | −19.9 | −9.7 | −1.3 | −0.5 | −0.2 | 7.7 | 17.9 | 28.0 |
| θ dl− θ dr | −2.0 | −2.0 | −2.0 | −1.5 | −1.0 | −1.5 | −2.0 | −2.0 | −2.0 |

UNIT [° ]

FIG. 12

[REVERSE]

| θ sw | −540 | −360 | −180 | −5 | 0 | 5 | 180 | 360 | 540 |
|---|---|---|---|---|---|---|---|---|---|
| θ dr | −30.0 | −20.0 | −10.0 | −0.3 | 0 | 0.3 | 10.0 | 20.0 | 30.0 |
| θ dl | −30.0 | −20.0 | −10.0 | −0.3 | 0 | 0.3 | 10.0 | 20.0 | 30.0 |
| θ dl− θ dr | 0 | 0 | 0 | 0 | 0 | 0 | 0 | 0 | 0 |

UNIT [° ]

OUTBOARD MOTOR CONTROL SYSTEM

BACKGROUND OF THE INVENTION

1. Field of the Invention

This invention relates to an outboard motor control system.

2. Description of the Related Art

A trend in outboard motor control systems in recent years is the emergence of drive-by-wire (DBW) systems that use actuators for one or more control operations among steering the outboard motor, changing its shift position, and regulating the speed of its internal combustion engine. The system comprises at least one actuator, a navigation unit for producing actuator drive commands in accordance with control input from the boat operator, and a control unit for controlling the operation of the actuator based on the output of the navigation unit.

As described in Japanese Laid-Open Patent Application No. 2004-52697 (particularly paragraphs 0023 to 0025), for example, boats are commonly equipped with two or more outboard motors mounted side-by-side in what is called a "multiple outboard motor installation." This reference is directed to enhance convenience by making it possible to start the engines of all installed outboard motors by operation of a single switch.

When multiple navigation units are provided, they are connected to the control units of the outboard motors in a one-to-one relationship. Therefore, if the navigation units should produce markedly different outputs owing to different control inputs, the control will become unstable because the control units cannot determine which navigation unit output should be given priority.

SUMMARY OF THE INVENTION

An object of this invention is therefore to overcome this problem by providing an outboard motor control system that enables stable control of outboard motors when multiple navigation units are provided for producing outputs indicating outboard motor operation commands.

In order to achieve the object, this invention provides a system for controlling an outboard motor mounted on a stern of a boat and having an internal combustion engine, comprising: an actuator for steering the outboard motor; an actuator for changing shift position of the outboard motor; an actuator for regulating a speed of the engine; a plurality of navigation units responsive to operation of an operator for producing an output indicative of a command to operate at least one of the actuators, a plurality of control units for controlling the operation of corresponding one of the actuators based on the output from the navigation units; an output forwarding unit for inputting the output of the navigation units and for forwarding the output of one of the navigation units to the control units; and a switchover button responsive to operation by the operator for switching the output to be forwarded by the output forwarding unit.

BRIEF DESCRIPTION OF THE DRAWINGS

The above and other objects and advantages of the invention will be more apparent from the following description and drawings in which:

FIG. 6 is a table showing some specific numerical values taken from the characteristics shown in FIG. 5;

FIG. 7 is a table similar to FIG. 6 showing some specific numerical values taken from the characteristics of the mapped data used in the flowchart of FIG. 4;

FIG. 10 is a table similar to FIG. 6 showing some specific numerical values taken from the characteristics of the mapped data used in the flowchart of FIG. 4;

FIG. 11 is a table similar to FIG. 6 showing some specific numerical values taken from the characteristics of the mapped data used in the flowchart of FIG. 4;

FIG. 12 is a table similar to FIG. 6 showing some specific numerical values taken from the characteristics of the mapped data used in the flowchart of FIG. 4;

DETAILED DESCRIPTION OF THE PREFERRED EMBODIMENT

An outboard motor control system according to a preferred embodiment of this invention will now be explained with reference to the attached drawings.

Figure 1:
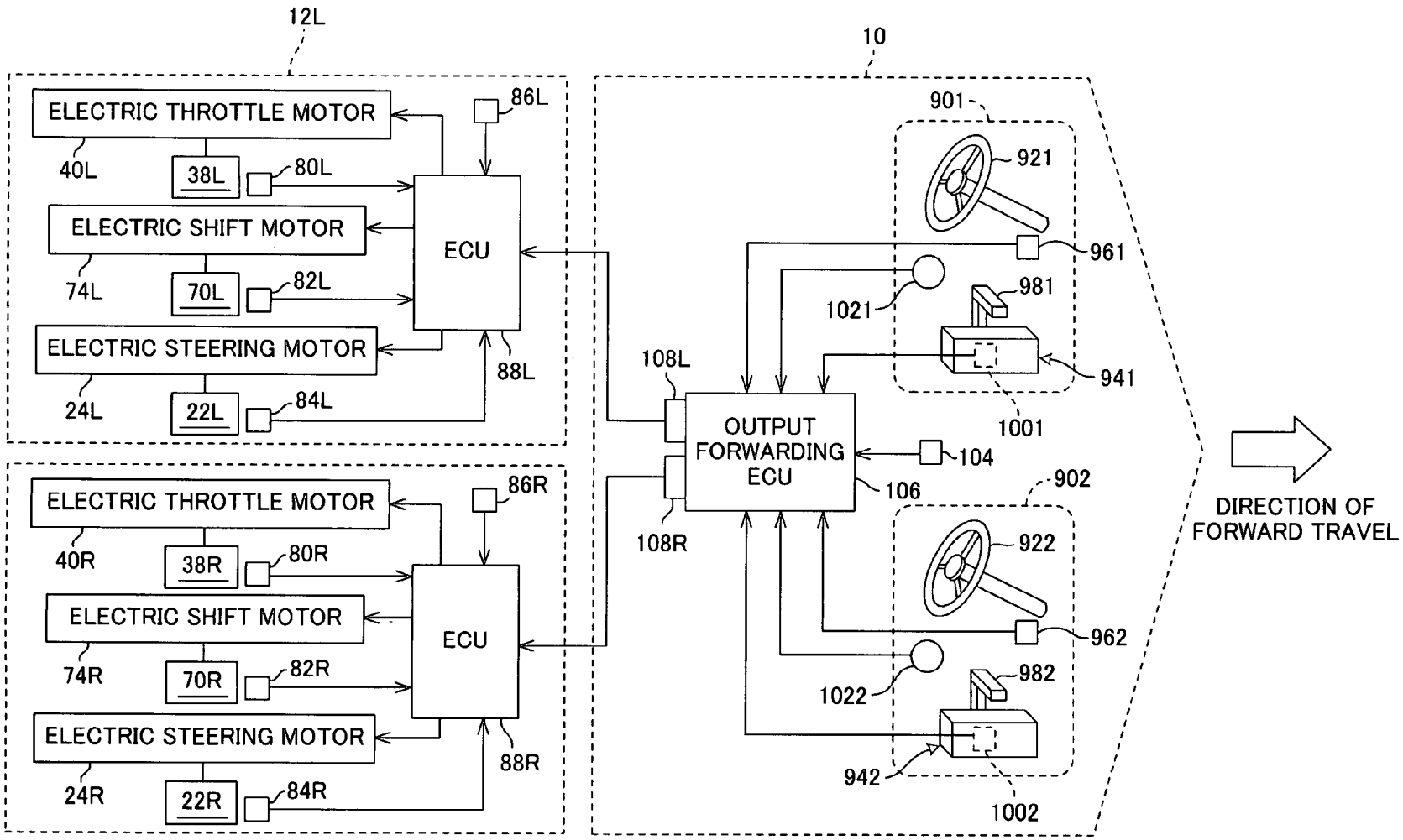
FIG. 1 is a block diagram showing an outboard motor control system according to an embodiment of this invention.

FIG. 1 is a block diagram showing an outboard motor control system according to an embodiment of this invention.

As shown in FIG. 1, a plurality of, more precisely two outboard motors are mounted on the stern of a boat (hull) 10. In other words, the boat 10 has what is known as a multiple or dual outboard motor installation. In the following, the starboard side outboard motor, i.e., outboard motor on the right side when looking in the direction of forward travel is called the "starboard outboard motor" and assigned the reference symbol 12R. The port side outboard motor, i.e., outboard motor on the left side when looking in the direction of forward travel is called the "port outboard motor" and assigned the reference symbol 12L.

Figure 2:
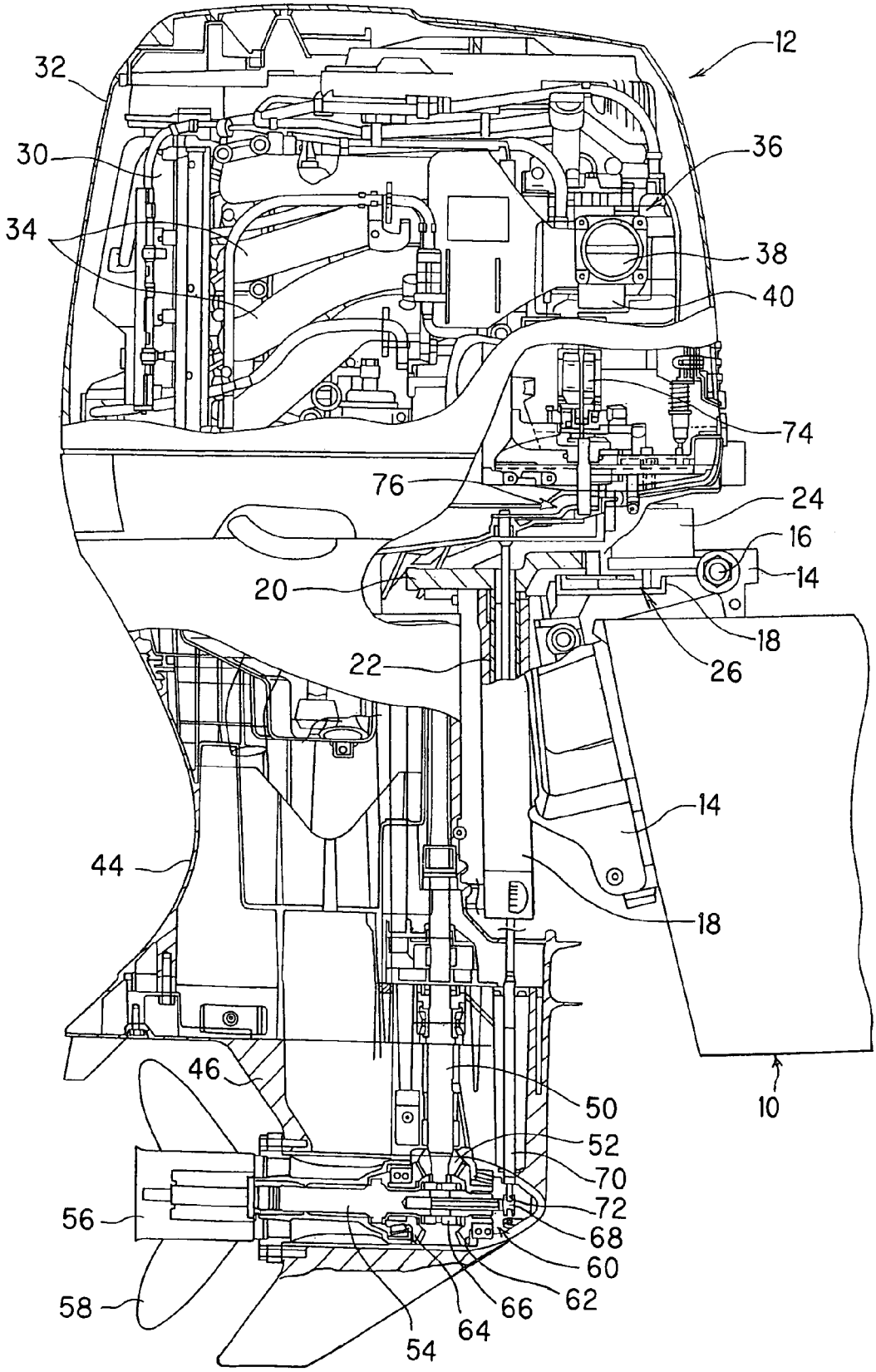
FIG. 2 is an enlarged side view of an outboard motor shown in FIG. 1.

FIG. 2 is an enlarged sectional side view of the outboard motor shown in FIG. 1. Since the configurations of the starboard outboard motor 12R and port outboard motor 12L are the same, the explanation with reference to FIG. 2 will be made without distinguishing between the starboard side and port side (i.e., indications of R and L will be omitted).

As shown in FIG. 2, the outboard motor 12 is equipped with stern brackets 14 fastened to the stern of the boat 10. A swivel case 18 is attached to the stern brackets 14 through a tilting shaft 16. A mount frame 20 installed in the outboard motor 12 is equipped with a shaft 22. The shaft 22 is housed in the swivel case 18 to be freely rotated about the vertical axis. The upper end of mount frame 20 and lower end thereof, i.e., lower end of the shaft 22 are fastened to a frame (not shown) constituting a main body of the outboard motor 12.

The upper portion of the swivel case 18 is installed with an electric steering motor (steering actuator) 24 that drives the shaft 22. The output shaft of the steering motor 24 is connected to the upper end of mount frame 20 via a speed reduction gear mechanism 26. Specifically, a rotational output generated by driving the steering motor 24 is transmitted via the speed reduction gear mechanism 26 to the mount frame 20 such that the outboard motor 12 is steered about the shaft 22 as a rotational axis to the right and left directions (i.e., steered about the vertical axis).

The outboard motor 12 is equipped with an internal combustion engine (hereinafter referred to as "engine") 30 at its upper portion. The engine 30 comprises a spark-ignition gasoline engine with a displacement of 2,200 cc. The engine 30 is located above the water surface and covered by an engine cover 32.

The engine 30 has an intake pipe 34 that is connected to a throttle body 36. The throttle body 36 has a throttle valve 38 installed therein and an electric throttle motor (throttle actuator) 40 is integrally disposed thereto to open and close the throttle valve 38. The output shaft of the throttle motor 40 is connected via a speed reduction gear mechanism (not shown) installed near the throttle body 36 with the throttle valve 38. Specifically, the throttle motor 40 is operated to open and close the throttle valve 38, thereby regulating air sucked in the engine 30 to control the engine speed.

An extension case 44 is installed at the lower portion of the engine cover 32 and a gear case 46 is installed at the lower portion of the extension case 44. A drive shaft (vertical shaft) 50 is supported in the extension case 44 and gear case 46 to be freely rotated about the vertical axis. One end, i.e., the upper end of the drive shaft 50 is connected to a crankshaft (not shown) of the engine 30 and the other end, i.e., the lower end thereof is equipped with a pinion gear 52.

A propeller shaft 54 is supported in the gear case 46 to be freely rotated about the horizontal axis. One end of the propeller shaft 54 extends from the gear case 46 toward the rear of the outboard motor 12 and a propeller 58 is attached thereto, i.e., the one end of the propeller shaft 54, via a boss portion 56.

A shift mechanism 60 is also housed in the gear case 46. The shift mechanism 60 comprises a forward (bevel) gear 62, reverse (bevel) gear 64, clutch 66, shift slider 68 and shift rod 70. The forward gear 62 and reverse gear 64 are disposed onto the outer periphery of the propeller shaft 54 to be rotatable in opposite directions by engagement with the pinion gear 52. The clutch 66 is installed between the forward gear 62 and reverse gear 64 and is rotated integrally with the propeller shaft 54.

The clutch 66 is connected via the shift slider 68 to a rod pin 72 disposed on the bottom of the shift rod 70. The rod pin 72 is formed at a location offset from the center of rotation of the shift rod 70 by a predetermined distance. As a result, rotation of the shift rod 70 causes the rod pin 72 to move while describing an arcuate locus whose radius is the predetermined distance (offset amount). The movement of the rod pin 72 is transferred through the shift slider 68 to the clutch 66 as displacement parallel to the axial direction of the propeller shaft 54. Accordingly, the clutch 66 is slid to a position where it engages one or the other of the forward gear 62 and reverse gear 64 or to a position where it engages neither of them.

The interior of the engine cover 32 is disposed with an electric shift motor (shift actuator) 74 that drives the shift mechanism 60. The shift rod 70 is disposed parallel to the vertical axis and the upper end thereof is connected to the output shaft of the shift motor 74 through a speed reduction gear mechanism 76. Therefore, when the shift motor 74 is driven, its rotational output is transmitted to the shift rod 70 through the speed reduction gear mechanism 76, thereby driving the clutch 66 to slide to conduct the shift (gear) change, i.e., the shift position is switched among forward, reverse and neutral positions.

The following explanation will be made with the indication of R or L added to the components shown in FIG. 2 to distinguish between the starboard side and port side.

The explanation of FIG. 2 will be resumed. The outboard motors 12R, 12L are equipped with throttle opening sensors 80R, 80L. The throttle opening sensors 80R, 80L are installed near the throttle valves 38R, 38L and produce outputs indicative of the throttle openings. The outboard motors 12R, 12L are further equipped with shift position sensors 82R, 82L and rudder angle sensors 84R, 84L. The shift position sensors 82R, 82L are installed near the shift rods 70R, 70L and produce outputs indicative of the shift positions, namely, the rotation angles of the shift rods 70R, 70L. The rudder angle sensors 84R, 84L are installed near the shafts 22R, 22L and produce outputs indicative of the rotation angles of the shafts 22R, 22L, namely, the rudder angles of the outboard motors 12R, 12L.

The outboard motors 12R, 12L are also equipped with crank angle sensors 86R, 86L. The crank angle sensors 86R, 86L are installed near the crankshafts of the engines 30R, 30L and produce outputs indicative of the speeds or rpm of the engines 30R, 30L.

The outputs of the foregoing sensors are sent to electronic control units (ECUs) 88R, 88L. The ECUs 88R, 88L are constituted as microcomputers each equipped with a CPU, ROM, RAM and other devices and mounted under the engine covers 32R, 32L of the outboard motors 12R, 12L.

The boat 10 is equipped with multiple, more precisely two in this embodiment navigation units 901, 902. In the following, the navigation unit 901 will be called the first navigation unit and the navigation unit 902 will be called the second navigation unit. The first navigation unit 901 and second navigation unit 902 each produces a set of outputs indicative of electric motor operation commands in accordance with operator control inputs. The first navigation unit 901 is equipped with a steering wheel 921 and remote control box 941. The second navigation unit 902 is equipped with a steering wheel 922 and a remote control box 942.

The steering wheels 921, 922 can be used or rotated by the operator to input rudder turning commands to the outboard motors 12R, 12L, i.e., commands for operating the steering motors 24R, 24L. Steering angle sensors 961, 962 installed near the rotary shafts of the steering wheels 921, 922 produce outputs indicative of the steering angles of the steering wheels 921, 922, i.e., the commands for operating the steering motors 24R, 24L.

The remote control boxes 941, 942 are equipped with shift/throttle levers 981, 982. The shift/throttle levers 981, 982 can be swung fore and aft by the operator to input shift position change commands (commands for operating the shift motors 74R, 7RL) and engine speed regulation commands (commands for operating the throttle motors 40R, 40L).

The remote control boxes 941, 942 are equipped with lever position sensors 1001, 1002. The lever position sensors 1001, 1002 produce outputs indicative of the positions of the shift/throttle levers 981, 982, i.e. the commands for operating the shift motors 74R, 74L and the commands for operating the throttle motors 40R, 40L.

The navigation units 901, 902 are also equipped with switchover buttons 1021, 1022. The switchover buttons 1021, 1022 output ON signals when pressed by the operator. A boat speed sensor 104 is installed at an appropriate location on the boat 10. The boat speed sensor 104 produces an output indicative of the speed of the boat 10.

The sets of outputs produced by the navigation units 901, 902 (outputs of the steering angle sensors 961, 962, lever position sensors 1001, 1002, and switchover buttons 1021, 1022) and the output of the boat speed sensor 104 are sent to an output forwarding ECU 106. The output forwarding ECU 106 is constituted as a microcomputer equipped with a CPU, ROM, RAM and other devices and is installed at an appropriate location on the boat 10.

The output forwarding ECU 106 is equipped with multiple (two in this embodiment) connectors 108R, 108L. In the following, the connector 108R located on the right side facing in the forward direction of travel of the boat 10 will be called the "right connector" and the connector 108L on the left side will be called the "left connector."

The right connector 108R is connected to the ECU 88R of the starboard outboard motor 12R. The left connector 108L is connected to the ECU 88L of the port outboard motor 12L. The output forwarding ECU 106 is responsive to a control input by the operator for forwarding the desired one of the inputted sets of navigation unit outputs, i.e. one or the other of the set of outputs of the first navigation unit 901 and the set of outputs of the second navigation unit 902, through the connectors 108R, 108L to the ECUs 88R, 88L.

The ECUs 88R, 88L control the operation of the motors based on the one set of outputs of the navigation units 901, 902 inputted from the output forwarding ECU 106. Specifically, they determine a desired shift position based on the output of one or the other of the lever position sensors 1001, 1002 (namely, the direction of manipulation of one or the other of the shift/throttle levers 981, 982) and control the operation of the shift motors 74R, 74L so as to make the outputs of the shift position sensors 82R, 82L equal to the desired shift position. Further, once it is detected from the outputs of the shift position sensors 82R, 82L that the desired shift position has been established (shift position change has been completed), they determine a desired throttle opening based on the output of one or the other of the lever position sensors 1001, 1002 (namely, the amount of manipulation of one or the other of the shift/throttle levers 981, 982) and control the operation of the throttle motors 40R, 40L to make the outputs of the throttle opening sensors 80R, 80L equal to the desired throttle opening.

Further, the ECUs 88R, 88L determine desired rudder angles of the outboard motors 12R, 12L based on the output of one or the other of the steering angle sensors 961, 962 and control the operation of the steering motors 24R, 24L so as to make the outputs of the rudder angle sensors 84R, 84L equal to the desired rudder angle. In this embodiment, the full steering angle range of the steering wheels 921, 922 is 1,080 degrees. In other words, the steering wheels 921, 922 turn lock-to-lock in three revolutions and can be rotated 540 degrees from the center position either clockwise or counterclockwise. The full rudder angle range of the outboard motors 12R, 12L is 60 degrees, so that the rudders of the outboard motors 12R, 12L can be rotated 30 degrees from the center position either clockwise or counterclockwise.

Thus the outboard motor control system according to this embodiment is a DBW control system without any mechanical interconnection between the navigation units and the outboard motors.

The set of outputs forwarded by the output forwarding ECU 106 is switched or changed in response to manipulation or pressing of the switchover buttons 1021, 1022. Specifically, when the operator presses one of the switchover buttons 1021, 1022, the set of outputs of the navigation unit to which the pressed switchover button belongs is forwarded to the ECUs 88R, 88L. This means that when the operator pushes the switchover button 1021 of the first navigation unit 901, the set of outputs of the first navigation unit 901 is forwarded to the ECUs 88R, 88L, and when the operator pushes the switchover button 1022 of the second navigation unit 902, the set of outputs of the second navigation unit 902 is forwarded to the ECUs 88R, 88L. In the following, the navigation unit whose set of outputs is forwarded to the ECUs 88R, 88L (the navigation unit used to navigate the boat 10) will be called the "active navigation unit."

The processing for output forwarding performed by the output forwarding ECU 106 will now be explained.

Figure 3:
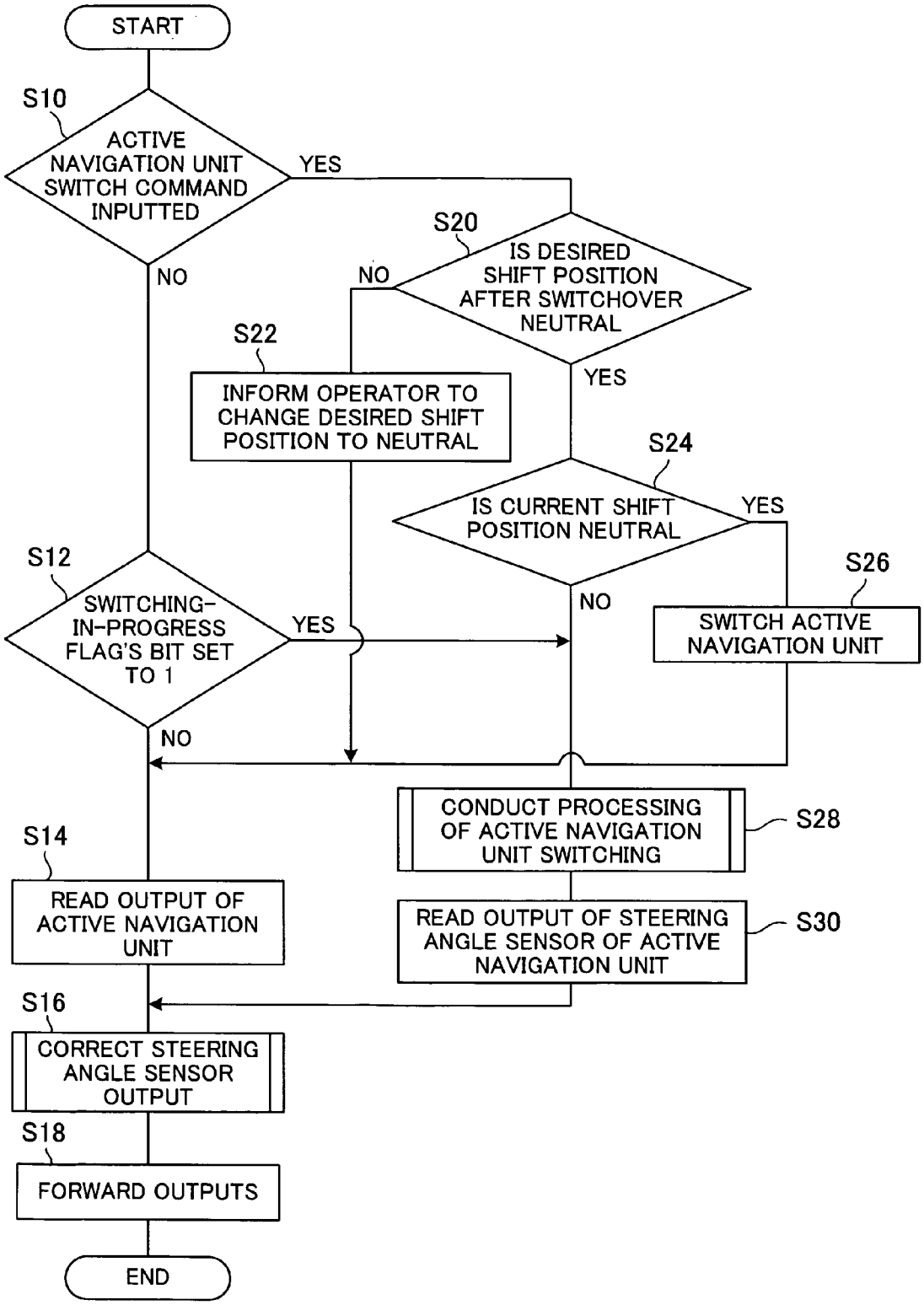
FIG. 3 is a main routine flowchart showing the flow of the processing for output forwarding performed by an output forwarding ECU shown in FIG. 1.

FIG. 3 is a main routine flowchart showing the flow of the processing. The routine of FIG. 3 is executed at regular intervals (e.g., every 10 msec).

The following explanation will be made taking as an example the processing conducted when switching the active navigation unit from the first navigation unit 901 to the second navigation unit 902, i.e., when the set of outputs to be forwarded by the output forwarding ECU 106 is switched from the set of outputs of the first navigation unit 901 to the set of outputs of the second navigation unit 902.

First, in S10, it is determined whether an active navigation unit switch command has been inputted, i.e., whether a command to switch the set of outputs forwarded to the ECUs 88R, 88L from the current set to the other set has been inputted. This determination is made by referring to the outputs of the switchover buttons 1021, 1022. Specifically, an active navigation unit switch command is determined to have been made when the switchover button of the navigation unit that is not the current active navigation unit (the switchover button 1022 of the second navigation unit 902 in this explanation) has been pushed and is outputting an ON signal.

When the result in S10 is NO, the program goes to S12, in which it is determined whether the bit of a switching-in-progress flag (initially 0) is reset to 0. The bit of the switching-in-progress flag is set to 1 in a processing step to be explained later and when so set indicates that processing for switching the active navigation unit is in progress.

When the result in S12 is NO, i.e., when no active navigation unit switch command has been inputted and processing for switching the active navigation unit is not in progress, the program goes to S14, in which the set of outputs of the current active navigation unit, i.e., the set of outputs of the first navigation unit 901 (the outputs of the steering angle sensor 961 and lever position sensor 1001), is read. Next, in S16, the read output of the steering angle sensor 961 is corrected.

Figure 4:
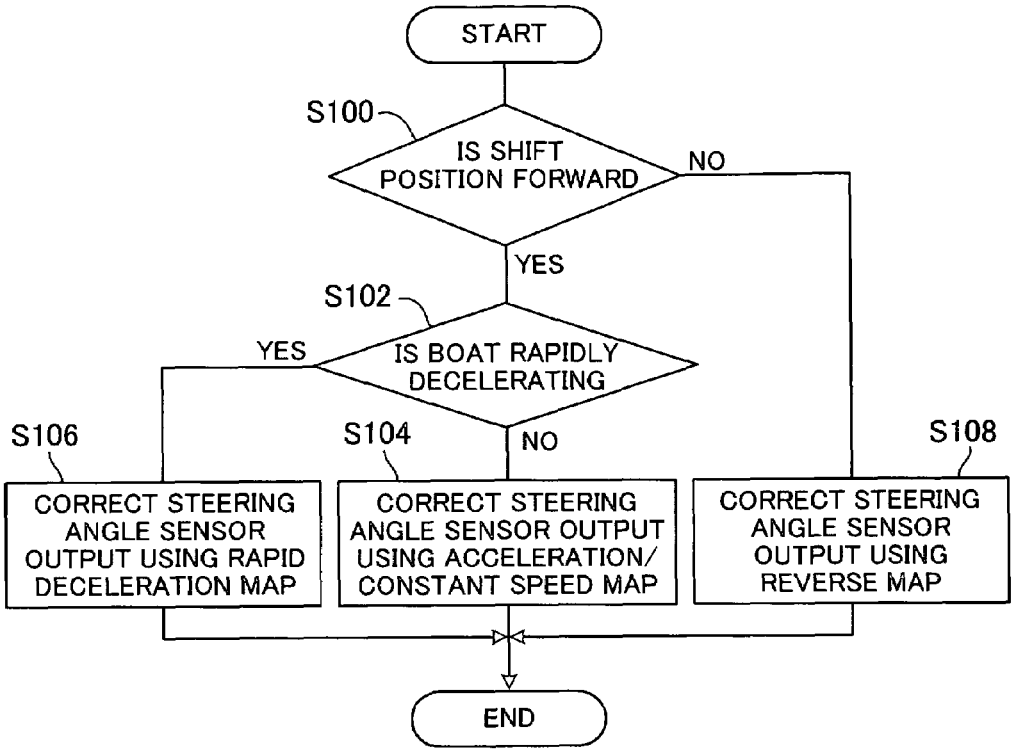
FIG. 4 is a subroutine flowchart showing the flow of the processing for correcting an output of a steering angle sensor performed by the flowchart of FIG. 3.

FIG. 4 is a subroutine flowchart showing the flow of the processing for correcting the output of the steering angle sensor.

The processing for correcting the output of the steering angle sensor will be explained with reference to the flowchart of FIG. 4.

First, in S100, it is determined whether the shift position is forward. This determination is made by referring to the outputs of the shift position sensors 82R, 82L of the outboard motors.

When the result in S100 is YES, the program goes to S102, in which the output of the boat speed sensor 104 (more exactly, the change therein) is checked to determine whether the boat 10 is rapidly decelerating. When the result in S102 is NO, i.e., when it is found that the boat 10 is accelerating or moving at a constant speed (defined as including gradual deceleration), the program goes to S104.

In S104, the steering angle sensor output is corrected to obtain separately an output to be sent to the ECU 88R of the starboard outboard motor and an output to be sent to the ECU 88L of the port outboard motor. As mentioned earlier, the ECUs 88R, 88L determine desired rudder angles for the outboard motors 12R, 12L based on the steering angle sensor output (or the corrected value thereof, as explained later). For easier understanding, explanation will be made here using the desired rudder angle (θdr) of the starboard outboard motor 12R in place of the output to be sent to the starboard outboard motor ECU 88R and the desired rudder angle (θdl) of the port outboard motor 12L in place of the output to be sent to the port outboard motor ECU 88L.

The values of the desired rudder angles θdr, θdl corresponding to the output of the steering angle sensor (steering angle of the steering wheel; θsw) are mapped and stored in the RAM (not shown) of the output forwarding ECU 106. Three kinds of maps are created, namely, acceleration/constant speed maps, a rapid deceleration map, and a reverse map. The acceleration/constant speed maps are established for different boat speeds. In S104, the map corresponding to the engine speed is selected from among the acceleration/constant speed maps and the values of the desired rudder angles θdr, θdl corresponding to the steering angle θsw of the steering wheel are determined by referring to the selected map.

Figure 5:
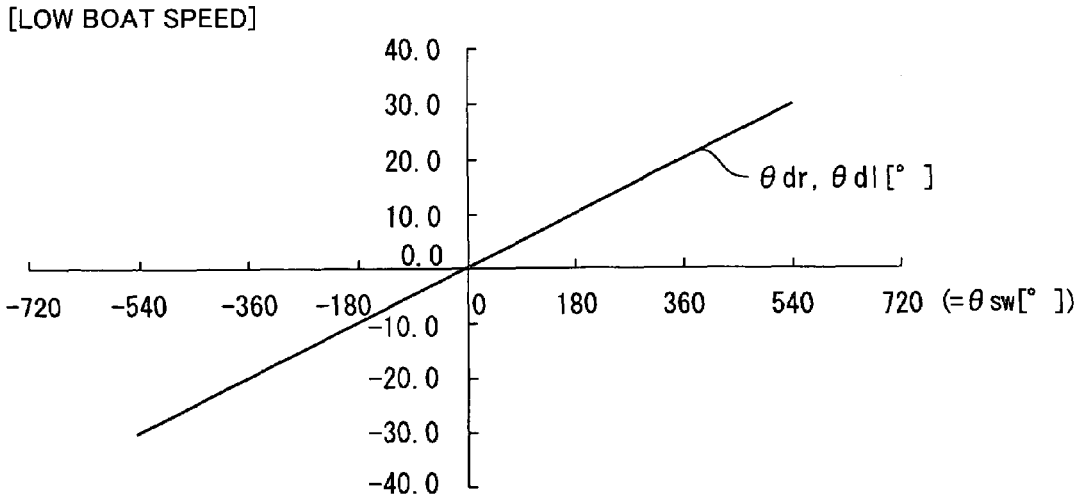
FIG. 5 is a graph showing the characteristics of mapped data (characteristics of desired rudder angle of the outboard motor with respect to steering angle of a steering wheel) used in the flowchart of FIG. 4.

FIG. 5 is a graph showing the characteristics of the mapped values in the acceleration/constant speed map used when the boat speed is low. FIG. 6 is a table showing some specific numerical values taken from the plot shown in FIG. 5. In this embodiment, the rudder turning direction when the outboard motors 12R, 12L are rotated clockwise as viewed from above (when the propellers move from right to left as viewed from behind) is defined as positive. The direction of rotation of the steering wheel when the outboard motors 12R, 12L are rotated clockwise is defined as positive.

As shown in FIGS. 5 and 6, when the boat speed is low, the desired rudder angle θdr of the starboard outboard motor and the desired rudder angle θdl of the port outboard motor are set to the same value (the difference between θdr and θdl is made 0). The rotary axis of the propeller (propeller shaft) of the starboard outboard motor 12R and the rotary axis of the propeller of the port outboard motor 12L are therefore maintained parallel irrespective of the rotation angle θsw of the steering wheel. This is because at low boat speed good straight course-holding performance and turning performance can be maintained without taking the relative angle between the outboard motors into account.

FIG. 7 is a table similar to that of FIG. 6 showing some specific numerical values taken from the acceleration/constant speed map used when the boat speed is medium.

As shown in FIG. 7, when the boat speed increases, the desired rudder angle θdr of the starboard outboard motor and desired rudder angle θdl of the port outboard motor are assigned different values. Specifically, when the rotation angle θsw of the steering wheel is 0 degree (i.e., when the operator wants to hold a straight course), θdr and θdl are made equal in absolute value but opposite in sign. For example, θdr is set to −0.4 degree and θdl is set to 0.4 degree. The difference between them (value obtained by subtracting θdr from θdl; designated Δθd) becomes 0.8 degree.

Figure 8:
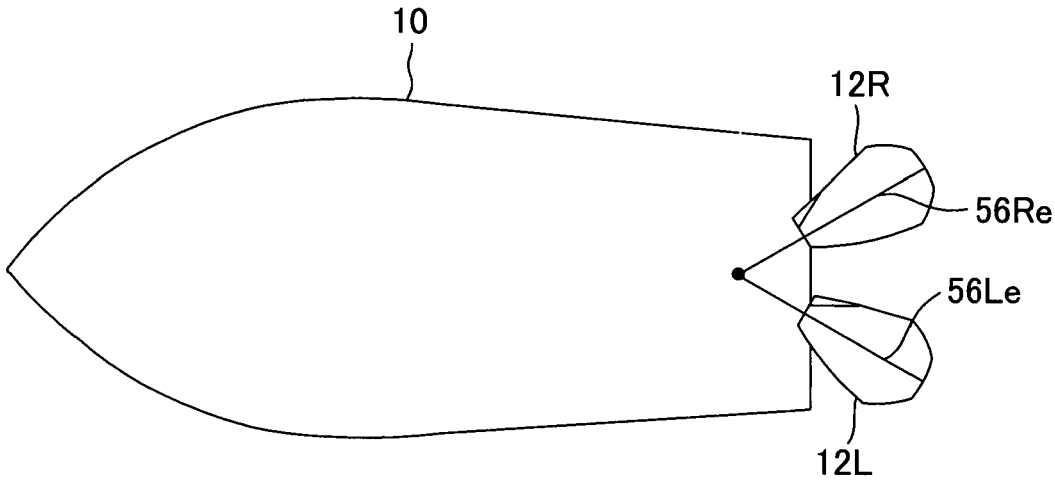
FIG. 8 is an explanatory view showing an example of the relative angle between a starboard outboard motor and port outboard motor shown in FIG. 1.

FIG. 8 is an explanatory diagram showing an example of the relative angle between the starboard outboard motor 12R and port outboard motor 12L.

As shown in FIG. 8, the setting of θdr to −0.4 degree turns the starboard outboard motor 12R counterclockwise, while setting θdl to 0.4 degree turns the port outboard motor 12L clockwise. As a result, the extension of the rotary axis of the propeller of the starboard outboard (designated 56Re) and the extension of the rotary axis of the propeller of the port outboard motor (designated 56Le) are made to intersect forward of the outboard motors 12R, 12L. This condition is referred to as "toe-in" and the difference Δθd at this time is referred to as the "toe-in angle." The toe-in angle is exaggerated in FIG. 8 to make it easy to recognize.

The explanation of FIG. 7 will be continued. The absolute values of the desired rudder angles θdr and θdl increase with increasing absolute value of the steering angle θsw. However, within the range of absolute value of the steering angle θsw under 5 degrees, the difference Δθd is set to the same value as when the steering angle Δθd is 0 degree, i.e., at 0.8 degree. In other words, toe-in is maintained so long as the boat 10 is moving straight ahead or nearly straight ahead. This improves straight course-holding by inhibiting side-to-side weaving of the boat 10.

When the absolute value of the steering angle θsw is in the range of 5 degrees to less than 180 degrees, i.e., when the boat 10 is turning, the difference Δθd is made 0 degree (θdr and θdl are assigned the same value). This undoes toe-in, thereby enhancing the turning performance of the boat 10.

Figure 9:
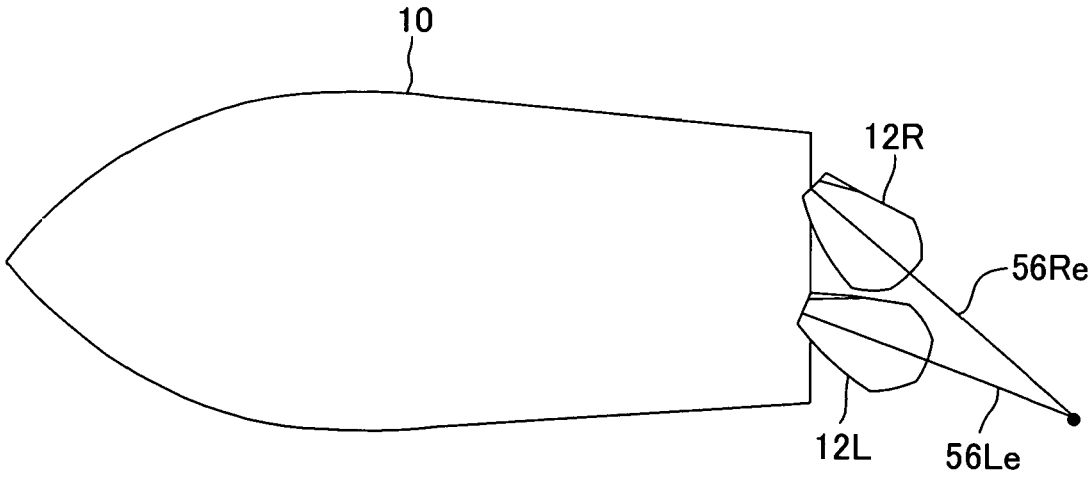
FIG. 9 is an explanatory view similarly showing an example of the relative angle between the starboard outboard motor and port outboard motor shown in FIG. 1.

When the absolute value of the steering angle θsw of the steering wheel reaches 180 degrees, the difference Δθd is made −0.8 degree. As shown in FIG. 9, during clockwise rotation of the outboard motors 12R, 12L (when the desired rudder angles θdr, θdl are positive values), the desired rudder angle θdr of the starboard outboard motor is made larger than the desired rudder angle of the port outboard motor, and during counterclockwise rotation (when the desired rudder angles θdr, θdl are negative values), the desired rudder angle θdl of the port outboard motor is made larger (in absolute value) than the desired rudder angle of the starboard outboard motor.

In other words, as shown in FIG. 9, the desired steering angle of the outboard motor on the opposite side from the turning direction of the boat 10 (the outside outboard motor) is made larger. As a result, the extension 56Re of the rotary axis of the propeller of the starboard outboard motor and the extension 56Le of the rotary axis of the propeller of the port outboard motor are made to intersect rearward of the outboard motors 12R, 12L. This condition is referred to as "toe-out" and the difference Δθd at this time is referred to as the "toe-out angle." Toe-out enhances turning performance. The toe-out angle is exaggerated in FIG. 9 to make it easy to recognize.

FIG. 10 is a table similar to that of FIG. 6 showing some specific numerical values taken from the acceleration/constant speed map used when the boat speed is high.

As shown in FIG. 10, when the boat speed increases further, the difference Δθd is increased in absolute value. Specifically, the difference Δθd is made 1.0 degree when the absolute value of the steering angle θsw of the steering wheel is in the range of 0 degree to less than 5 degrees and is made −1.0 degree when the absolute value of the steering angle θsw is 180 degrees or greater. This increases the toe-in angle when the boat is moving straight ahead and the toe-out angle when the boat is turning sharply, thereby ensuring good straight course-holding performance and turning performance during high-speed cruising.

The explanation of the flowchart of FIG. 4 will be continued. When the result in S102 is YES (i.e., when it is found that the boat 10 is rapidly decelerating), the program goes to S106, in which the output of the steering angle sensor is corrected taking the rapid deceleration map into account.

FIG. 11 is a table similar to that of FIG. 6 showing some specific numerical values taken from the rapid deceleration map.

As shown in FIG. 11, when the steering angle θsw of the steering wheel is 0 degree during rapid deceleration, θdr and θdl are made 0.5 degree and −0.5 degree, so that the difference Δθd is made −1.0 degree. When the absolute value of the steering angle θsw of the steering wheel is greater than 0 degree, the desired rudder angle of the outboard motor on the opposite side from the turning direction of the boat 10 (the outside outboard motor) is made larger (larger in absolute value).

In other words, the desired rudder angles θdr, θdl are set to constantly maintain toe-out during rapid deceleration irrespective of the steering angle θsw. In addition, the absolute value of the difference Δθd (toe-out angle) is set to a larger value than that during acceleration or constant-speed cruising. Good straight course-holding performance and turning performance are therefore maintained even during rapid deceleration. The outboard motors are made to toe-out when the boat 10 is moving straight forward during rapid deceleration because the directions of the forces acting on the boat 10 are opposite from those acting on it during acceleration or constant-speed cruising. The reason for increasing the absolute value of the difference Δθd with increasing steering angle θsw is the same as that during acceleration or constant-speed cruising.

The explanation of the flowchart of FIG. 4 will be continued. When the result in S100 is NO, i.e., when the shift position is found to be reverse (or neutral), the program goes to S108, in which the desired steering angles θdr, θdl are assigned by referring to the reverse map.

FIG. 12 is a table similar to that of FIG. 6 showing some specific numerical values taken from the reverse map.

As shown in FIG. 12, when the boat is moving in reverse, the difference Δθd is made 0 degree irrespective of the steering angle θsw of the steering wheel, so that the extension 56Re of the axis of rotation of the propeller of the starboard outboard motor and the extension 56Le of the axis of rotation of the propeller of the port outboard motor are constantly maintained parallel. That is, neither toe-in nor to-out is implemented because the speed of the boat when moving in reverse is usually very slow.

The output forwarding ECU 106 forwards the output corresponding to the desired rudder angle θdr from the right connector 108R to the ECU 88R of the starboard outboard motor and forwards the output corresponding to the desired rudder angle θdl from the left connector 108L to the ECU 88L of the port outboard motor.

The explanation of the flowchart of FIG. 3 will be resumed.

Next, in S18, the output of the steering angle sensor 961 (or the corrected value thereof) and the output of the lever position sensor 1001 are forwarded to the ECUs 88R, 88L of the outboard motors 12R, 12L. Specifically, the ECU 88R connected to the right connector 108R is sent the output of the lever position sensor 1001 as a command to operate the shift motor 74R and the throttle motor 40R. It is also sent the output of the steering angle sensor 961 (or the corrected value thereof; value corresponding to the desired rudder angle θdr) as a command to operate the steering motor 24R. Further, the ECU 88L connected to the left connector 108L is sent the output of the lever position sensor 1001 as a command to operate the shift motor 74L and the throttle motor 40L. It is also sent the output of the steering angle sensor 961 (or the corrected value thereof; value corresponding to the desired rudder angle θdl) as a command to operate the steering motor 24L.

When the result in S10 is YES, the program goes to S20, in which it is determined whether the desired shift position after active navigation unit switchover is neutral. Specifically, it is determined based on the output of the lever position sensor 1002 whether the shift/throttle lever 982 of the second navigation unit 902 is set in neutral position. When the result in S20 is NO, the program goes to S22, in which a buzzer, display or other appropriate notification device (none of which shown) is used to prompt the operator to manipulate the shift/throttle lever 982 so that the desired shift position after switchover will be neutral. Next, the program goes to S14. Thus active navigation unit switching is not implemented until the shift/throttle lever of the navigation unit to be switched to (the second navigation unit 902) has once been put in neutral.

When the result in S20 is YES, the program goes to S24, in which it is determined whether the current shift position is neutral. Specifically, it is determined based on the output of the lever position sensor 1001 whether the shift/throttle lever 981 is set in neutral position.

When the result in S24 is YES, i.e., when the output values of the lever position sensor 1001 and lever position sensor 1002 are the same, the program goes to S26, in which the active navigation unit is switched from the first navigation unit 901 to the second navigation unit 902. That is, the set of outputs to be forwarded by the output forwarding ECU 106 is switched from the outputs of the lever position sensor 1001 and steering angle sensor 961 to the outputs of the lever position sensor 1002 and steering angle sensor 962. The processing of S14 to S18 is then conducted.

When the result in S24 is NO, the program goes to S28, in which processing in preparation for active navigation unit switching is conducted. Since the values of the set of outputs that the output forwarding ECU 106 is to forward to the ECUs 88R, 88L (in particular the output of the shift position sensor) may differ between before and after switchover, the processing of S28 is conducted for gradually changing the outputs to be forwarded from the outputs before switching to the outputs after switchover.

Figure 13:
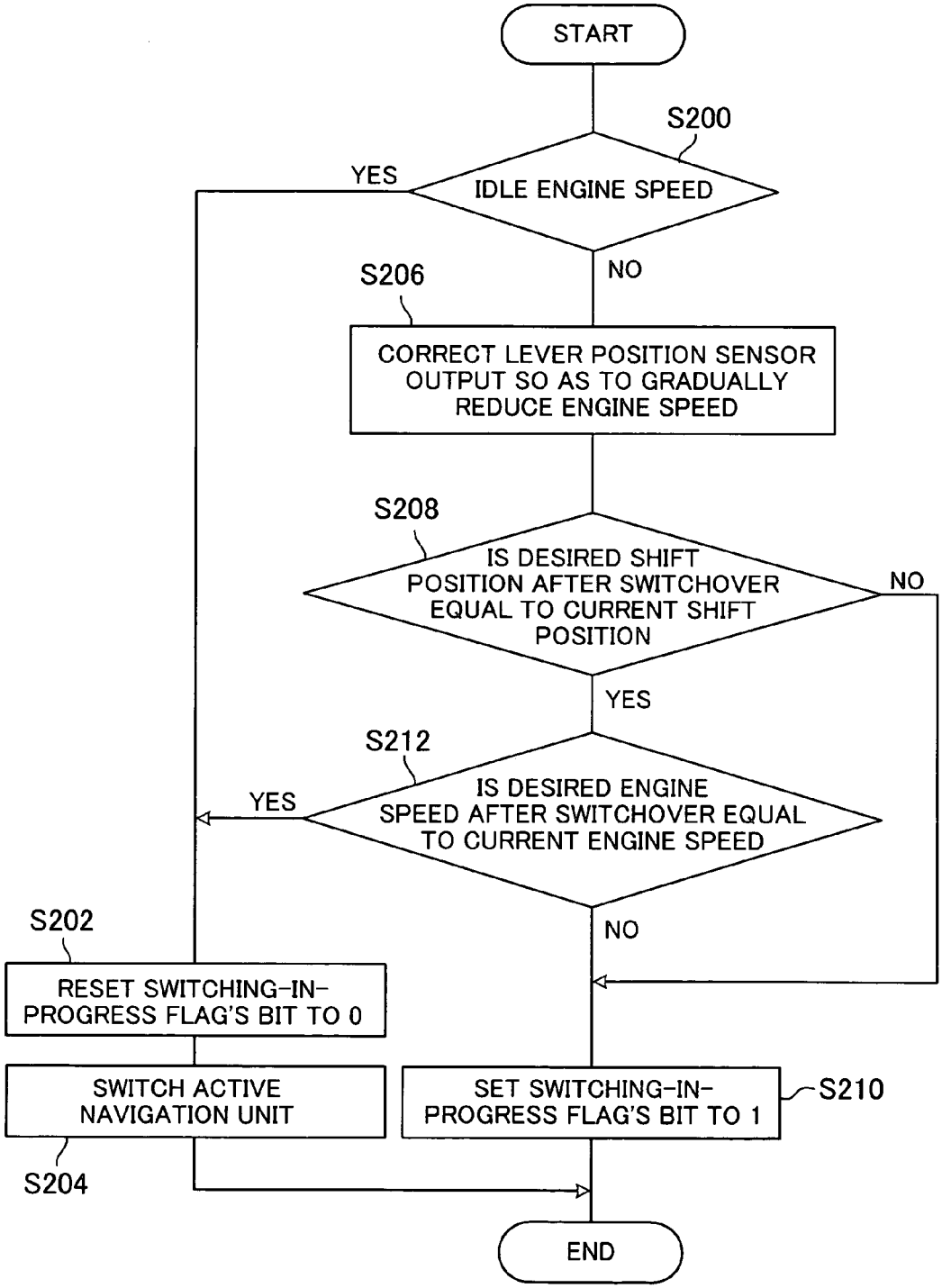
FIG. 13 is a subroutine flowchart showing the flow of the processing conducted in the subroutine of FIG. 3 in preparation for active navigation unit switching.

FIG. 13 is a subroutine flowchart showing the flow of the processing conducted in the subroutine of FIG. 3 in preparation for active navigation unit switching.

The preparatory processing for active navigation unit switching will now be explained with reference to the flowchart of FIG. 13.

First, in S200, it is determined whether the engine speed is idle speed. This determination is made based on the output of the lever position sensor 1001 (or the corrected value thereof) forwarded from the output forwarding ECU 106 in the previous routine cycle. When the result in S200 is YES, the program goes to S202, in which the bit of the switching-in-progress flag is reset to 0, and to S204, in which the active navigation unit is switched or changed. Active navigation unit switching is effected at idle engine speed in order to avoid shift error or disruption of boat behavior in a case where the shift position is changed as soon as the set of outputs to be forwarded is changed.

When the result in S200 is NO, the program goes to S206, in which the output of the lever position sensor of the current active navigation unit (the lever position sensor 1001 of the first navigation unit 901) is corrected so as to gradually reduce the engine speed. Next, in S208, it is determined whether the desired shift position after switchover is equal to the current shift position. This determination is made by comparing the outputs of the lever position sensor 1001 and lever position sensor 1002.

As will be understood from the earlier explanation of the processing of S20 to S22 in the routine of FIG. 3, the result in S208 is NO the first time the subroutine of FIG. 13 is executed. When the result in S208 is NO, the program goes to S210, in which the bit of the switching-in-progress flag is set to 1. When the bit of the switching-in-progress flag is set to 1, the result in S12 of the routine of FIG. 3 is YES, which causes the subroutine of FIG. 13 to be executed. Therefore, during the period from the input of the command to switch the active navigation unit (from the pressing of the switchover button) to the time point at which the engine speed reaches idle speed, the result in S208 is YES so long as the shift/throttle lever of the navigation unit to be switched to is set in the same direction as the shift/throttle lever of the active navigation unit (so long as the desired shift position after switchover is equal to the current shift position).

When the result in S208 is YES, the program goes to S212, in which it is determined whether the desired engine speed after switchover is the same as the current engine speed. Like the determination in S208, this is also made by comparing the outputs of the lever position sensor 1001 and lever position sensor 1002. When the result in S212 is YES, the program goes to S202 and S204 to switch the active navigation unit. When it is NO, another cycle of the subroutine of FIG. 13 is executed after passing through S210.

Figure 14:
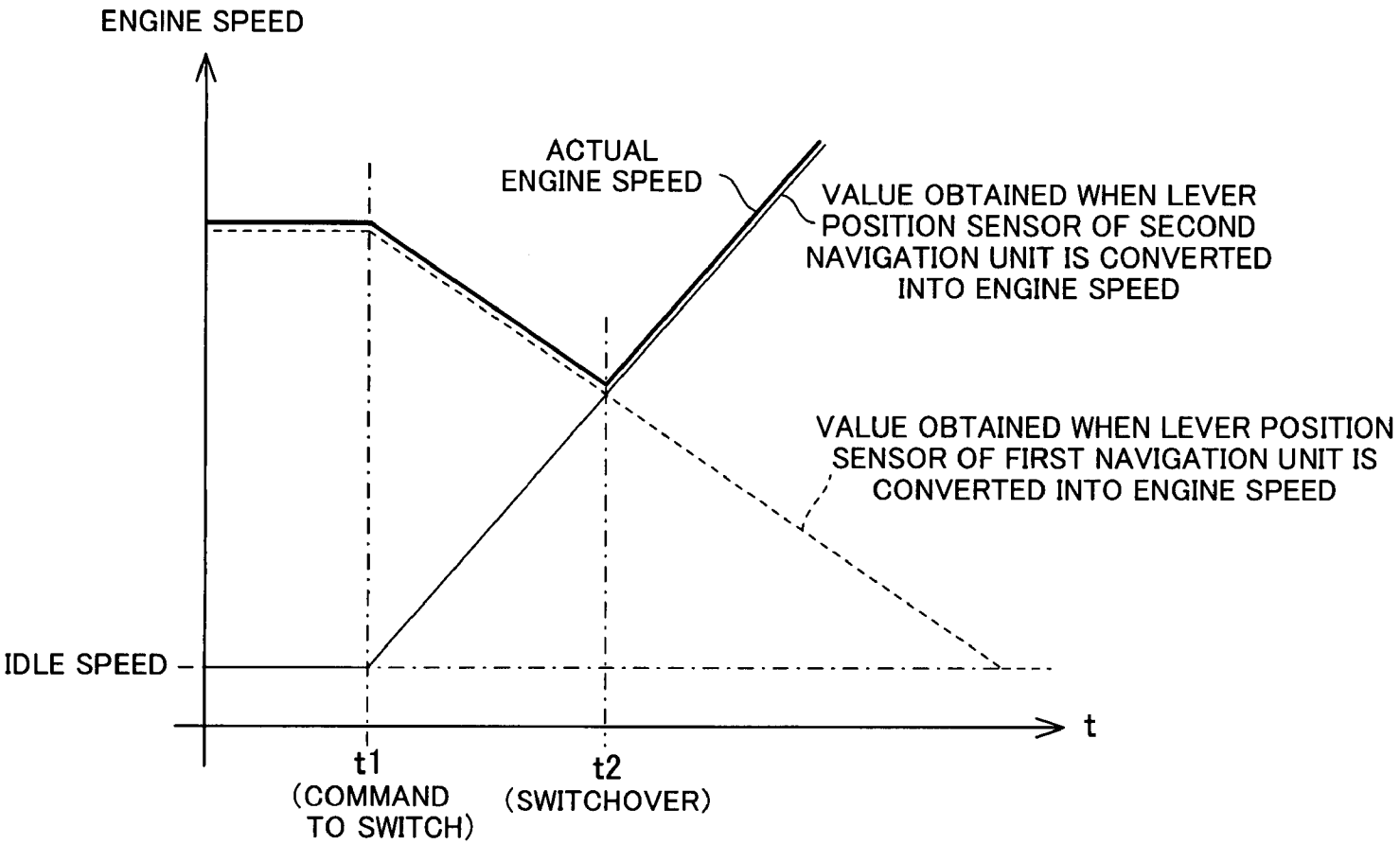
FIG. 14 is a time chart showing the processing performed by the subroutine of FIG. 13.

FIG. 14 is a time chart showing the processing performed by the subroutine of FIG. 13.

The processing performed by the subroutine of FIG. 13 will be explained again with reference to the time chart of FIG. 14.

As shown in FIG. 14, when a command to switch the active navigation unit is inputted (time t1), the output of the lever position sensor 1001 of the first navigation unit, i.e., the active navigation unit, is gradually changed (corrected) toward that of the second navigation unit. Owing to the fact that the shift/throttle lever 982 of the second navigation unit to be switched to is once set to neutral when a command to switch the active navigation unit is inputted, the output of the lever position sensor 1001 is gradually reduced toward the value indicating the idle speed (S206).

While the engine speed is being reduced, the shift/throttle lever 982 of the second navigation unit is moved in the same direction as the shift/throttle lever 981 of the first navigation unit (S208). When the output (corrected value) of the lever position sensor 1001 of the first navigation unit and the output of the lever position sensor 1002 of the second navigation unit become the same (the current engine speed and the desired engine speed after switchover become the same), the active navigation unit is at that time point (time t2) switched to the second navigation unit 902 (S212), whereafter the engine speed is regulated in accordance with the output of the lever position sensor 1002.

On the other hand, when the shift/throttle lever 982 of the second navigation unit was not moved out of neutral, the active navigation unit is switched to the second navigation unit 902 at the time point when output of the lever position sensor 1001 has decreased to the value indicating the idle speed (S200 to S204).

The explanation of the flowchart of FIG. 3 will be resumed. The program next goes to S30, in which the output of the steering angle sensor of the active navigation unit is read, whereafter the aforesaid processing of S16 and S18 is conducted.

The processing conducted for switching the active navigation unit from the second navigation unit 902 to the first navigation unit 901 is similar to the foregoing.

The preferred embodiment of the invention described above is a DBW outboard motor control system equipped with the outboard motors 12R, 12L which use actuators (electric motors) for steering, changing shift position and regulating engine speed, the two navigation units 901, 902 responsive to operations of the operator for producing sets of outputs indicative of actuator operation commands, and the ECUs 88R, 88L that control the operation of the actuators based on the sets of outputs from the navigation units 901, 902. The DBW outboard motor control system further comprises the output forwarding ECU 106 which inputs the sets of outputs of the navigation units 901, 902 and forwards the set of outputs of one of the navigation units to the ECUs 88R, 88L, and the switchover buttons 1021, 1022 responsive to operation by the operator for changing the set of outputs to be forwarded by the output forwarding ECU 106. Therefore, only the set of outputs for the one navigation unit selected by the operator (the active navigation unit) is sent to the ECUs 88R, 88L. In other words, in the case where multiple navigation units are provided, use of the navigation units for navigation is limited to a desired one thereof, so that the outboard motors can be stably controlled even when the control inputs to the individual navigation units are different.

Moreover, when the value of an output to be forwarded differs between before and after switchover, the output forwarding ECU 106 gradually changes the output to be forwarded from the output before switchover (in the foregoing example, the output of the lever position sensor 1001 of the first navigation unit) to the output after switchover (the output of the lever position sensor 1002 of the second navigation unit). This prevents the boat behavior from being disrupted at the time of switching between navigation units.

Further, the output forwarding ECU 106 corrects the output of the steering angle sensor 961 or 962 that detects the steering angle of the steering wheel 921 or 922. This correction is effected by setting the output forwarded to the ECU 88R of the starboard outboard motor and the output forwarded to the ECU 88L of the port outboard motor to different values to regulate the relative angle (establish toe-in or toe-out) between the starboard outboard motor 12R and port outboard motor 12L. This enhances the straight course-holding performance and turning performance of the boat. In addition, the output forwarding ECU 106 separately defines the set of outputs sent to the ECU 88R (i.e., the set of outputs forwarded through the right connector 108R) and the set of outputs forwarded to the ECU 88L (i.e., the set of outputs forwarded through the left connector 108L). The ECUs 88R, 88L are therefore not required to know the location (starboard side or port side) of their associated outboard motors. This enables the ECUs to use the same software, which is advantageous in terms of cost.

The embodiment is thus configured to have a system for controlling an outboard motor (starboard outboard motor 12R and port outboard motor 12L) mounted on a stern of a boat (10) and having an internal combustion engine, comprising: an actuator (electric steering motor 24R, L) for steering the outboard motor; an actuator (electric shift motor 74R, L) for changing shift position of the outboard motor; an actuator (electric throttle motor 40R, L) for regulating a speed of the engine; a plurality of navigation units (first navigation unit 901, second navigation unit 902) responsive to operation of an operator for producing an output indicative of a command to operate at least one of the actuators, a plurality of control units (ECU 88R, 88L) for controlling the operation of corresponding one of the actuators based on the output from the navigation units; an output forwarding unit (ECU 106) for inputting the output of the navigation units and for forwarding the output of one of the navigation units to the control units; and a switchover button (1021, 1022) responsive to operation by the operator for switching the output to be forwarded by the output forwarding unit.

In the system, the output forwarding unit gradually changes the output to be forwarded from the output from before switchover, when a value of the output to be forwarded differs between before and after switchover (S206 in FIG. 13).

In the system, the output is an output of a lever position sensor (1001, 1002) that produces at least one of an output indicative of a command of the operator to change the shift position and an output indicative of a command of the operator to regulate the engine speed.

In the system, the output forwarding unit corrects the output of a steering angle sensor (961, 962) that detects a steering angle of a steering wheel (921, 922) manipulated by the operator.

The system further includes; a second outboard motor (starboard outboard motor 12R and port outboard motor 12L) mounted on the stern of the boat and having an internal combustion engine.

In the system, the output forwarding unit corrects the outputs of steering angle sensors (961, 962) that detect steering angles of steering wheels manipulated by the operator.

In the system, the output forwarding unit corrects the outputs of the steering angle sensors such that the outputs to be forwarded to the outboard motors become different to regulate a relative angle (establish toe-in or toe-out) between the outboard motors.

In the embodiment explained in the foregoing, the switching of the active navigation unit involves processing for gradually changing (correcting) the output of the shift position sensor from the value before switchover to that after switchover. Similar processing can also be implemented with respect to the output of the steering angle sensor.

Although the foregoing embodiment is explained with reference to a multiple outboard motor installation comprising two outboard motors mounted on the boat 10, the invention can also be applied to multiple outboard motor installations comprising three or more outboard motors. Although all of the actuators for outboard motor steering and the like were exemplified as electric motors, it is possible instead to utilize hydraulic cylinders or any of various other kinds of actuators.

Japanese Patent Application No. 2005-124862 filed on Apr. 22, 2005, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling an outboard motor mounted on a stern of a boat and having an internal combustion engine, comprising:

an actuator for steering the outboard motor;

an actuator for changing shift position of the outboard motor;

an actuator for regulating a speed of the engine;

a plurality of navigation units responsive to operation of an operator for producing outputs indicative of a command to operate at least one of the actuators, a plurality of control units for controlling the operation of said at least one of the actuators based on the outputs from the navigation units;

an output forwarding unit for inputting the outputs of the navigation units and for forwarding the output of one of the navigation units to the control units; and a plurality of switchover buttons responsive to operation by the operator for switching the output to be forwarded by the output forwarding unit, wherein the output forwarding unit gradually changes the output to be forwarded from the output before switchover to the output after switchover, when a value of the output to be forwarded differs between before and after switchover.

2. The system according to claim 1, wherein the outputs of the navigation units are outputs of a lever position sensor that produces at least one of an output indicative of a command of the operator to change the shift position and an output indicative of a command of the operator to regulate the engine speed.

3. The system according to claim 1, wherein the navigation units include a steering angle sensor that detects a steering angle of a steering wheel manipulated by the operator, and the output forwarding unit corrects an output of the steering angle sensor.

4. The system according to claim 3, wherein the output forwarding unit corrects the outputs of the steering angle sensor based on at least one of boat speed, boat acceleration and boat travelling direction.

5. The system according to claim 1, further including;

a second outboard motor mounted on the stern of the boat and having an internal combustion engine;

a second actuator for steering the second outboard motor;

a second actuator for changing shift position of the second outboard motor; and a second actuator for regulating a speed of the engine of the second outboard motor; and wherein the navigation units outputs are indicative of commands to selectively operate the actuators associated with both of the outboard motors.

6. The system according to claim 5, wherein the navigation units include steering angle sensors that detect steering angles of steering wheels manipulated by the operator, and the output forwarding unit corrects outputs of the steering angle sensors.

7. The system according to claim 6, wherein the output forwarding unit corrects the outputs of the steering angle sensors such that the outputs to be forwarded to the outboard motors become different to regulate a relative angle between the outboard motors.

8. The system according to claim 6, wherein the output forwarding unit corrects the outputs of the steering angle sensors based on at least one of boat speed, boat acceleration and boat travelling direction.

9. The system according to claim 1, wherein the output forwarding unit gradually changes the output to be forwarded from the output before switchover to the output after switchover until a value of the output to be forwarded is substantially the same before and after switchover.

* * * * *